US007833109B2

(12) United States Patent
Dras

(10) Patent No.: US 7,833,109 B2
(45) Date of Patent: Nov. 16, 2010

(54) SLOW MOTION TRAINING FOR OPTIMAL POINT OF IMPACT

(76) Inventor: Ernest Dras, Zrkovska 114/a, Maribor (SI) 2000

( * ) Notice: Subject to any disclaimer, the term of this patent is extended or adjusted under 35 U.S.C. 154(b) by 0 days.

(21) Appl. No.: 12/511,392

(22) Filed: Jul. 29, 2009

(65) Prior Publication Data

US 2010/0190585 A1 Jul. 29, 2010

Related U.S. Application Data

(63) Continuation-in-part of application No. PCT/IB2008/053148, filed on Aug. 5, 2008.

(60) Provisional application No. 60/963,546, filed on Aug. 6, 2007.

(51) Int. Cl.
*A63B 69/36* (2006.01)

(52) U.S. Cl. ..... 473/219; 473/226; 473/235

(58) Field of Classification Search ..... 473/219–262, 473/290, 390–392
See application file for complete search history.

(56) References Cited

U.S. PATENT DOCUMENTS

| | | | | |
|---|---|---|---|---|
| 1,600,466 | A | 9/1926 | Goldsworthy | |
| 3,101,948 | A | 8/1963 | Campbell | |
| 3,325,168 | A | 6/1967 | Fyanes | |
| 3,384,376 | A * | 5/1968 | Greenlee | 473/236 |
| 3,401,941 | A | 9/1968 | Hesidence | |
| 5,082,284 | A * | 1/1992 | Reed | 473/235 |
| 5,435,572 | A | 7/1995 | Covel | |
| 5,709,611 | A | 1/1998 | Intag | |
| 6,015,353 | A | 1/2000 | Romano | |
| 6,244,973 | B1 | 6/2001 | Eichelberger | |
| 6,296,574 | B1 | 10/2001 | Kaldis | |
| 6,849,001 | B2 | 2/2005 | Simpson | |

FOREIGN PATENT DOCUMENTS

DE 20001329 U1 3/2000

OTHER PUBLICATIONS

Jump USA Internet web site, JUMPUSA.COM, http://www.jumpusa.com/flush_hit_driver.html, last downloaded Jul. 23, 2008.
European Patent Office, International Search Report on parent PCT application No. PCT/IB2008/053148, filed Aug. 5, 2008, EPO, P.B. 5818 Patentlaan 2, NL—2280 HV Rijswijk, The Netherlands.

* cited by examiner

*Primary Examiner*—Nini Legesse
(74) *Attorney, Agent, or Firm*—Louis Ventre, Jr.

(57) ABSTRACT

A device and method is disclosed for training a person in slow motion to hit a ball at the sweet spot on a sports implement. The device includes a housing and a plate. The housing preferably comprises a tube; a rod slidably fitting within the tube; a stop affixed to the end of the rod; a compression spring surrounding the rod; and a ball on the rod at the end opposite the stop such that the end of the rod protrudes from the ball. The plate is affixed to the sports implement at its sweet spot and has a center hole of sufficient size to contain the end of the rod protruding from the ball. In the preferred method, a player swings the sports implement in slow motion towards the ball on the housing engaging the plate at the center hole over the protruding rod.

9 Claims, 8 Drawing Sheets

SLOW MOTION TRAINING FOR OPTIMAL POINT OF IMPACT

CROSS-REFERENCE TO RELATED APPLICATIONS

This application is a continuation-in-part of Patent Cooperation Treaty Application No. PCT/IB2008/053148, filed 5 Aug. 2008, which claims the benefit of U.S. Provisional Application No. 60/963,546, filed 6 Aug. 2007, both of which applications are hereby incorporated by reference herein.

TECHNICAL FIELD

In the field of games using a tangible projectile, a device and method is disclosed to enable a player to improve physical skills in using swingable implement to put the projectile into motion in accordance with an objective of the game.

BACKGROUND ART

Full swing training methods are known in the art and these typically involve launching the ball with full force in normal speed. For example, U.S. Pat. No. 5,709,611 ('611 patent) is for a retractable golf club alignment device and method for use for assisting a golfer to hit the sweet spot of a golf ball.

The sweet spot is the optimal point of impact on the sports instrument to impart maximal energy to a ball, send it on a predictable and desired trajectory and deliver the best feeling when hitting the ball.

The device of the '611 patent comprises a retractable extension pin mounted through the optimum spot on the clubface. The golfer attempts to strike the ball flush with the retractable pin, just as he would strike it with the clubface and the ball is launched just as in actual play. If he is off the sweet spot, the ball trajectory is affected.

The present invention is different from the '611 patent in that it does not encumber the club with a weighty device, does not use a pin on the clubface to affect ball trajectory, does not use full speed swings, and the ball does not launch from being struck, which is important because it requires significant area for use. The present invention is different in that it uniquely promotes player concentration between strokes.

Using a pin on the clubface with a fixed Styrofoam target is known. For example, U.S. Pat. No. 6,244,973 ('973 patent) teaches a training device for developing a golfer's swing based on a principle of driving a spike fixed to the sweet spot of a striking surface of a golf club into the flat target surface to permit penetration and fixation of the spike in the target surface.

The present invention is different from the device disclosed in the '973 patent in that the present invention is not used with a full speed swing, does not have a spike on the club, and does not penetrate a target with a spike. The present invention is different in that it uniquely promotes player concentration between strokes.

A common failing in the prior art is that all include interruptions between a player's practice strokes. The present invention is not susceptible to this failing and provides a means for repetitive strokes, without interruptions.

An example this prior art is a product called Flush Hit Golf described at a website of the same name that uses a club with a hole in its face that matches the ball. If a player hits the ball perfectly, the Flush Hit Driver captures the Flush Hit golf ball in the hole in the face of the driver. If a player successfully catches the ball inside the hole, then the player must use a separate tool to get the ball out of the hole and then replace the ball on the tee before the player can start with the next shot. If the player is not successful in catching the ball in the hole, then the ball flies away, and he must either use another ball or fetch the one just hit. The point is that this prior art and all others like it inherently include interruptions in player concentration, which is avoided by the present invention: A player can go deeper and deeper in concentration without interruptions. For example, a player could sequentially execute 100 strokes without any distractions, that is, without stopping from first stroke to last.

An example this prior art is a product called Flush Hit Golf described at a website of the same name that uses a club with a hole in its face that matches the ball. If a player hits the ball perfectly, the Flush Hit Driver captures the Flush Hit golf ball in the hole in the face of the driver. If a player successfully catches the ball inside the hole, then the player must use a separate tool to get the ball out of the hole and then replace the ball on the tee before the player can start with the next shot. If the player is not successful in catching the ball in the hole, then the ball flies away, and he must either use another ball or fetch the one just hit. The point is that this prior art and all others like it inherently include interruptions in player concentration, which is avoided by the present invention: A player can go deeper and deeper in concentration without interruptions. For example, a player could sequentially execute 100 strokes without any distractions, that is, without stopping from first stroke to last.

SUMMARY OF INVENTION

A device and method is disclosed for training a person in slow motion to hit a ball at the sweet spot on a sports implement, with a primary application to golfing. [31] The preferred device includes two principal components: a housing that holds a ball with a pin which extends from the surface of the ball; and a plate removably affixed to the sports implement at its sweet spot and configured to define a center hole of sufficient size to fit over the pin. The housing is preferably configured to be removably affixed to a surface to hold it in place.

A preferred embodiment of the housing includes: a tube having an internal lip at one end and adjustable as to horizontal disposition on the housing; a rod slidably fitting within the tube; a stop affixed to an end of the rod to stop movement of the rod in one direction by abutting the end of the tube with the lip; a compression spring surrounding the rod and configured to slidably fit within the tube up to the internal lip in the tube so as to resist movement of the rod through the tube; a ball affixed to an end of the rod opposite the stop; and, a pin affixed to the ball and configured to extend from the ball. Optionally, a shock-absorbing rubber bumper is placed between the stop and the end of the tube with the internal lip.

In the preferred method of using the device, a player implements steps comprising swinging the sports implement in slow motion towards the ball on the housing; concentrating on the end of the rod protruding from the ball; engaging the plate at the center hole over the end of the protruding rod; and, withdrawing the sports implement. Optionally, a player engages the plate with sufficient force for sliding the rod within the tube and thereby compressing the compression spring.

TECHNICAL PROBLEM

A better solution is needed to the problem of effective training to hit the sweet spot of an instrument used in any sport where a player swings the instrument to hit a projectile. Golf is the principal exemplar used herein for discussion of the invention. However, the same principles apply to any such sport, such as baseball, softball, polo, badminton, squash, and table tennis.

A leading expert in the field of golf observed that millions of dollars annually spent on equipment does not seem to correspond to any improvement in the average handicap of golfers. This expert also noted that golf swing instruction is similarly unconnected to such improvement.

The problem is that even with a golf swing that looks just perfect, a player may not have the point of impact under exact control. For example, even with a perceptively perfect swing, if a golfer misses the sweet spot by as little as 15 mm, the ball will change its direction and there will be less power delivered to the ball.

TECHNICAL SOLUTION

The key to improving a golf handicap is training designed to improve precision in the point of impact such that the sweet spot on the golf club is consistently hit, especially for full swing shots. The device and method of the invention promote awareness and control over what is happening on the clubface at the moment of impact. This enables a player be able to build trust in his shot.

In using the invention, the backswing and the downswing are executed slowly and smoothly. Such slow, smooth, accentuated and precise movements are well known in the training of ancient Eastern martial arts and are not practiced for the sake of slowness, but as a means to an end, to discern and to experience the motion in detail, body and mind. In this way, the path of the sweet spot (yellow plate with a small hole) through the swing is strongly impressed upon one's mind. Additionally, a great deal of concentration and feeling is needed for aligning the small hole on the pin that juts out of the ball. This literally draws a player's awareness to the striking surface and automatically the player becomes more and more conscious of it. This leads to more control at the moment of impact.

The invention promotes a player's feeling for correct timing. Deviations in timing can emerge if one does not have enough control over the moment the clubface touches the ball and because of that the full strength of the swing 'explodes' to soon. The result is that one actually hits the ball in follow through and because of that there is a loss of power. At the moment when the mass of a ball sits on the clubface and begins to leave it, the speed of the clubhead must be the greatest (relating to the entire swing). The invention promotes learning to swing through the ball.

ADVANTAGEOUS EFFECTS

The invention: 1) increases player recognition of the importance of hitting the ball at the optimal point of impact; 2) focuses player attention on two crucial impact points governing maximal effect: the spot of first impact on the ball; and the sweet spot on the instrument; 3) increases awareness of the moment when the clubface touches the ball (important for good timing); and, 4.) teaches a player to swing through the ball; and, 5) ingrains by force of habit, a sharp and precise path of the sweet spot through the swing.

BRIEF DESCRIPTION OF DRAWINGS

The drawings show preferred embodiments of the invention and the reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
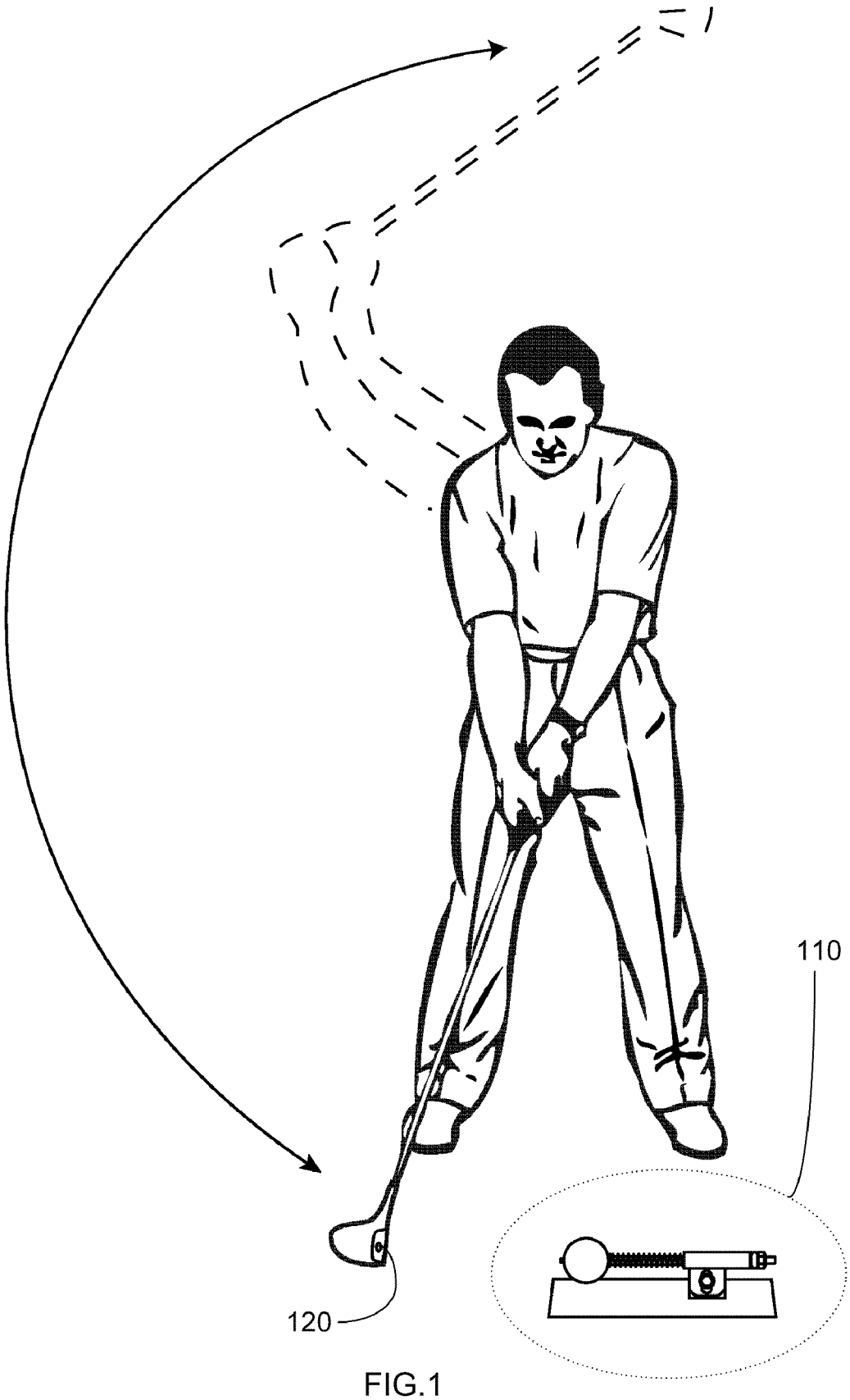
FIG. 1 is a frontal view of a golfer using the device having a plate on the club face engaging a pin on a housing.

FIG. 1 illustrates the use of the device for a golfer and shows the housing (110) and the plate (120) affixable to the golf club. While the exemplary and primary application is to golfing, the device and method is for training a person in slow motion to hit a ball at the sweet spot on a sports implement in all applications where a player uses a swingable implement to put a projectile into motion in accordance with an objective of the game.

The housing (110) is configured to be removably affixed to a surface such that it does not move relative to the player upon being struck with the golf club (218). Any relatively immovable surface may be used, such as for example, the ground, a floor of a building or the deck of a ship. It may be removably affixed to the surface using any means common or convenient for such purpose, for example using double sided tape, glue, nails, clamps, or weights.

Figure 2:
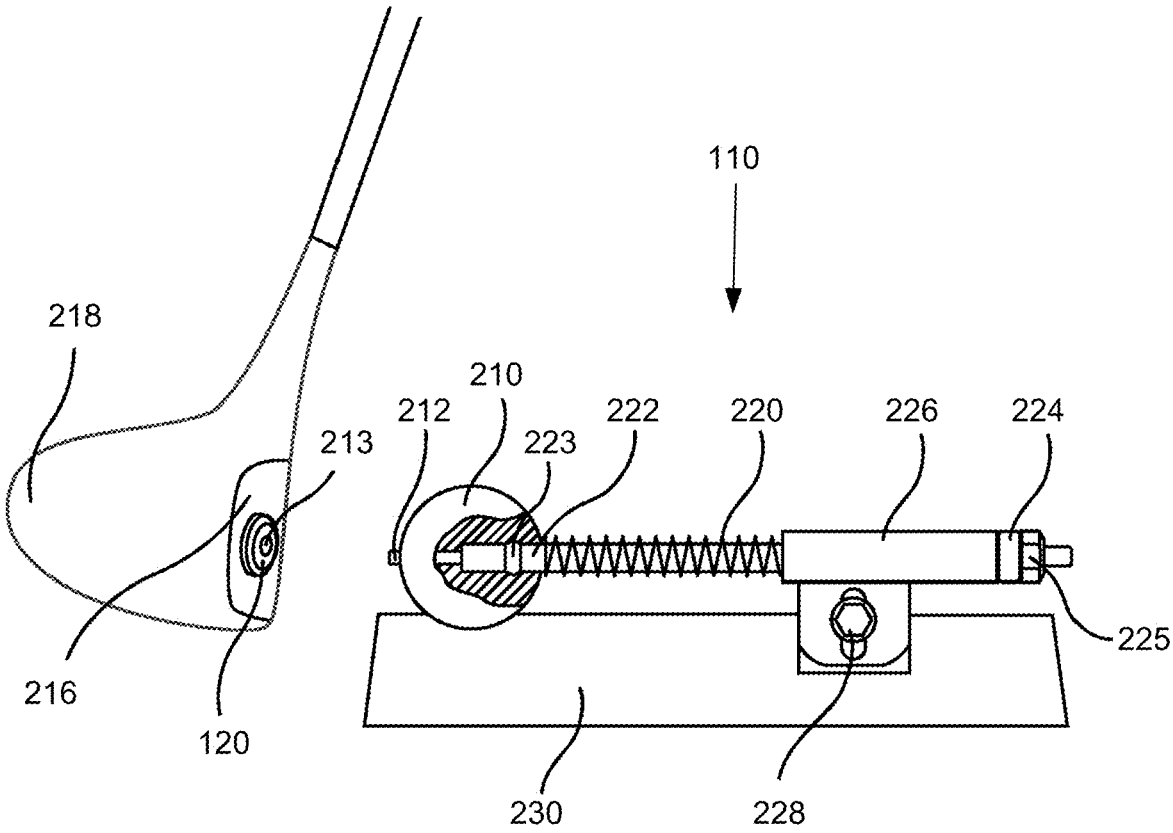
FIG. 2 is a side perspective of the device in use with a golf club immediately prior to impact.

FIG. 2 illustrates preferred components of the housing (110).

The housing (110) first includes a tube (226) having an internal lip at one end. The tube (226) is adjustably fixed to the housing (110) so that its horizontal and vertical orientation can be adjusted by a player, for example, to accommodate positioning the housing on a surface which may not be level and to adjust the height of the tube (226) from the surface. Preferably, the tube (226) is adjustably fixed to the housing (110) with the use of a bolt (228) that connects the tube (226)

with a slotted hole in the base plate (230). This arrangement provides a means to adjust the height of the tube (226) and thus the height of the ball (210) above the surface where the device is being used. The tube (226) in cross-section may be round, oval, square, triangular, rectangular or have any cross sectional shape suitable to the function of the tube in the housing. An angle bracket attached to the base plate (230) and a flat plate with an elongated central hole attached to the tube, as shown in FIG. 2, is a common connection means that permits adjustment of the tube (226) and which may be used for this purpose. A preferred cross-sectional dimension of the tube (226) is about 10 mm and a preferred length is about 60 mm. The lip at one end of the tube (226) narrows the internal bore of the tube (226) and provides a physical abutment for the compression spring (220) to prevent the compression spring (220) from moving through the tube when assembled in the housing (110), yet permits a rod (222) to move through the tube (226) resisted by a compression spring (220).

The housing (110) next includes a rod (222) that slidably fits within the tube (226). Preferably the rod is a solid bar of aluminum or other metal. A preferred the length of the rod is about 200 mm.

The housing (110) next includes a stop (225) affixed to an end of the rod to stop movement of the rod (222) in one direction by abutting the end of the tube (226) with the lip. The stop (225) shown in FIG. 2 is a nut. Preferably, the rod (222) would be threaded so that a threaded nut may be used. Alternatively, the stop (225) may be thrust washer seated in a groove at the end of the rod (222), a cotter pin, a rubber o-ring that is seated in the groove, or other means known in the art to stop the rod (222) from sliding out of the tube (226). Optionally, as shown in FIG. 2, a shock-absorbing rubber bumper (224) is placed between the stop (225) and the end of the tube (226) to which it abuts.

Figure 3:
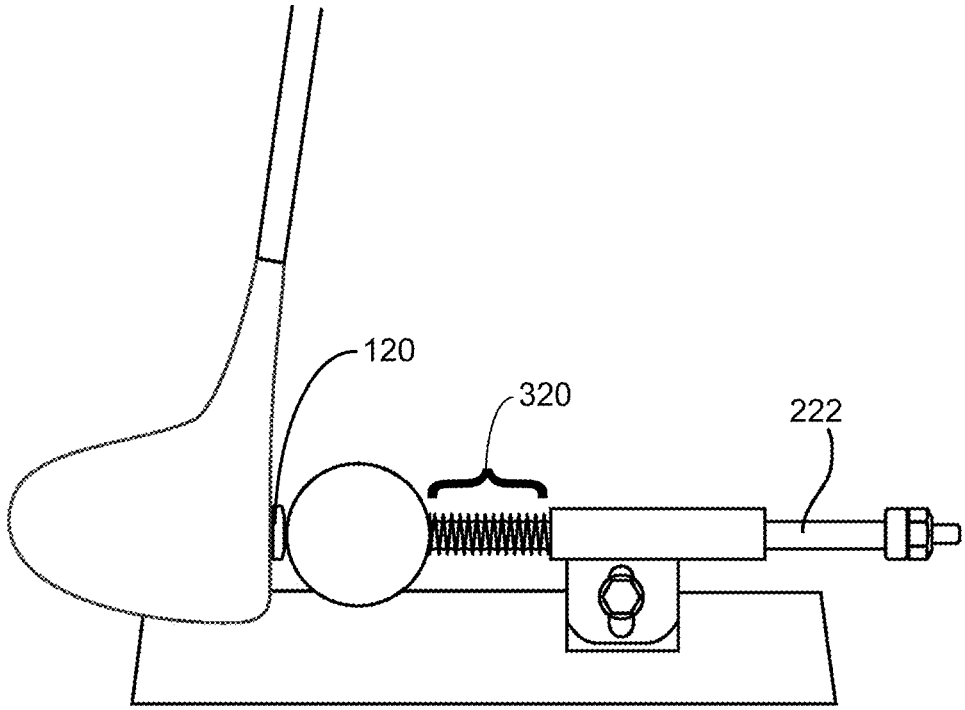
FIG. 3 is a side perspective of the device in use with a golf club at the end of a player's stroke and showing a compressed spring.
Figure 4:
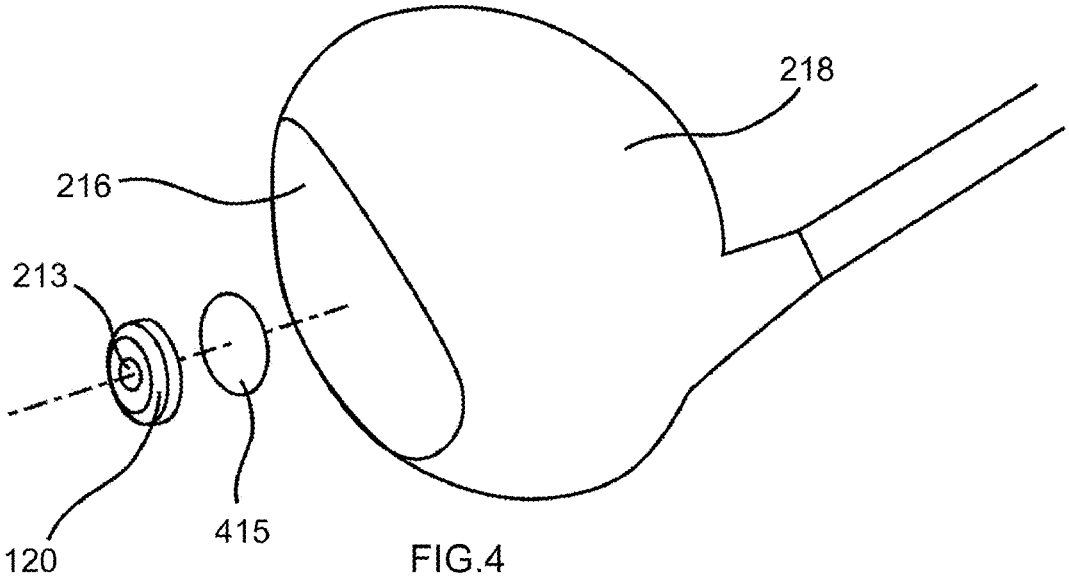
FIG. 4 is a perspective of parts of the device affixable to a golf club.

The housing (110) next includes a compression spring (220) surrounding the rod (222) and configured to slidably fit within the tube (226) up to the internal lip in the tube so as to resist movement of the rod (222) through the tube (226). As shown in FIG. 3, the compression spring (220) may be in a compressed state (320) after impact of the pin (212) with the plate (120). A preferred length of the compression spring (220) uncompressed is about 75 mm and 30 mm when compressed. While a coiled compression spring is preferred and shown in the figure, the compression spring may be made of rubber or other material serving the same purpose of compression and recoil.

Figure 5:
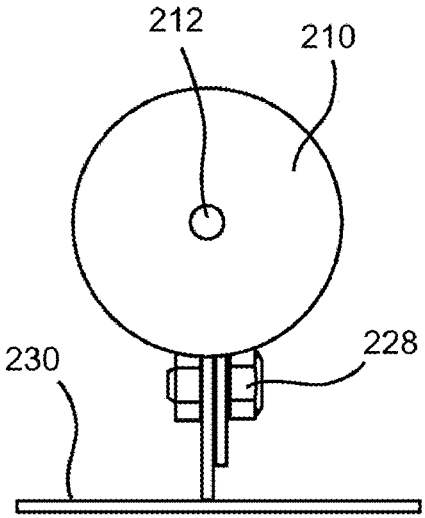
FIG. 5 is an end view of the housing of the device at the end closest to the ball.
Figure 6:
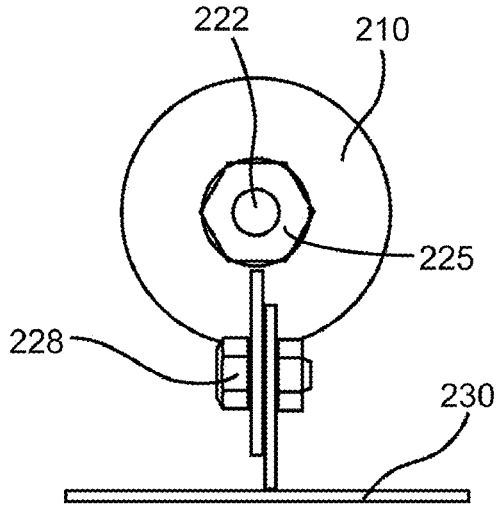
FIG. 6 is an end view of the housing of the device at the end farthest from the ball.

The housing (110) next includes a ball (210) affixed to an end of the rod (222) opposite the stop (225), as shown in FIG. 2 and FIG. 5. The ball (210) may be any type of projectile impelled by human effort through the use of an instrument in a game. The ball (210) is preferably held on the rod (222) using an embossment (223) fitting over the rod and configured to provide a friction fit of the ball (210) on the rod. Thus, the embossment (223) fits over the rod (222) to extend its diameter and provide a secure friction fit of a golf ball on the rod (222). When the ball (210) is hollow, for example a tennis ball, a clamp or other means may be used to secure the ball (210) on the rod (222).

The housing (110) next includes a pin (212) affixed to the ball and configured to extend radially outward from the ball (210), preferably in an approximate horizontal alignment. Preferably the pin (212) is an integral part of the rod (222), as shown in FIG. 2. In other embodiments, it is a separate component which is optionally attached to the rod (222). When the pin (222) is an integral part of the rod (222), the pin (212) is preferably of a smaller cross-section than the rest of the rod (222). The preferred cross-sectional dimension of the pin (212) is in a range of about 1-10 millimeters. The pin (212) is optionally colored for better visibility and for better impression in the mind of the player.

The device secondly includes a plate (120) removably affixed to the sports implement at its sweet spot and configured to define a center hole (213) therethrough of sufficient size to contain the pin (212) protruding from the ball (210). For sports implements configured with a flat impact face, such as a golf club or a baseball bat, the plate (120) is preferably removably affixed to the impact face (216) of the sports instrument using double-sided tape (415). For sports implements having strings for the impact face, such as a tennis racket (820), the plate (120) is preferably grooved around the edge so that it may be removably wedged between the strings and held in place by the strings.

The plate may be colored for better visibility and for better impression in the mind of the player.

Figure 7:
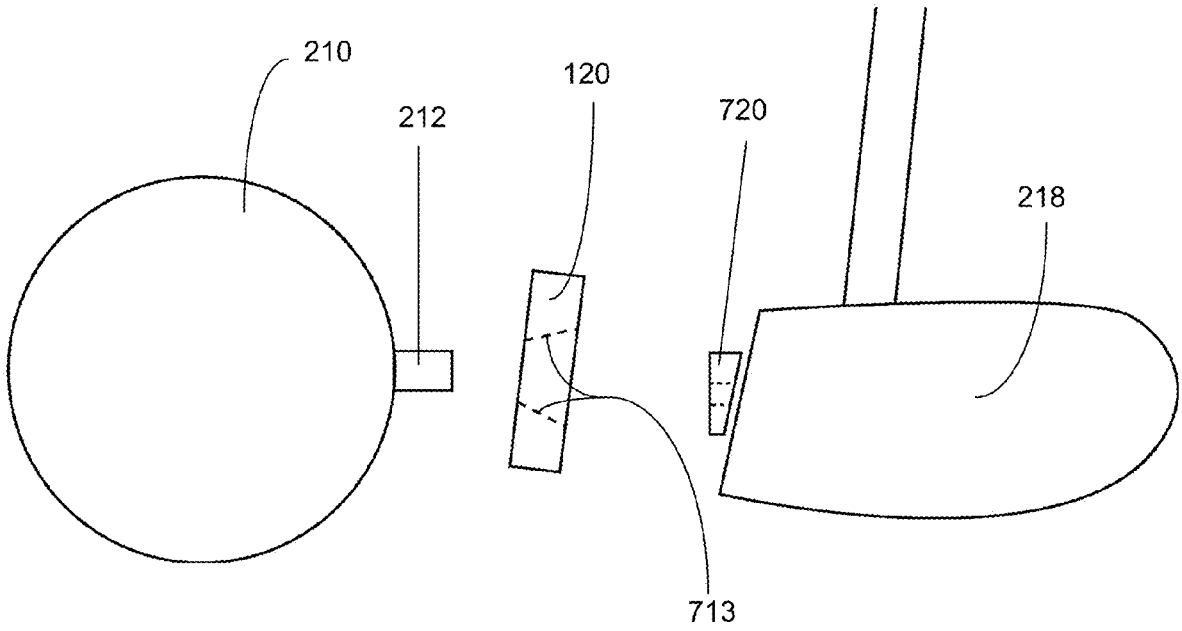
FIG. 7 is a side view illustrating alternative embodiments of the plate.

The plate (120) may have a uniform cross sectional thickness or may be inclined to suit the angle of the impact face of a golf club, which is commonly referred to as the loft angle. There are golf clubs with different loft angles. A plate (120) for a driver is preferably one having a uniform cross-section. As shown in FIG. 7, the plate (720) may have an irregular cross section as may be suitable for other clubs.

For training, the difference in diameter between the pin (212) and the hole (213) may be useful in various embodiments. The smaller the difference, the more difficult it is to align the hole (213) with the pin (212). The diameter of the hole (213) is preferably not more than about three millimeters larger than the pin (212). So, optionally, there can be a plurality of plates to provide different sized holes for the same pin (212). For example, if the pin is 4 mm, a beginner can use the plate (120) with a hole (213) of 6 mm. On the other hand, an accomplished golfer might use plate (120) with a hole (213) of 4.8 mm for the same pin. The hole (213) may have an irregular cross section or tapered hole (713), as shown in FIG. 7. A tapered hole (713) makes it easier to align the pin and the hole (213), or provides a greater loft angle.

Figure 8:
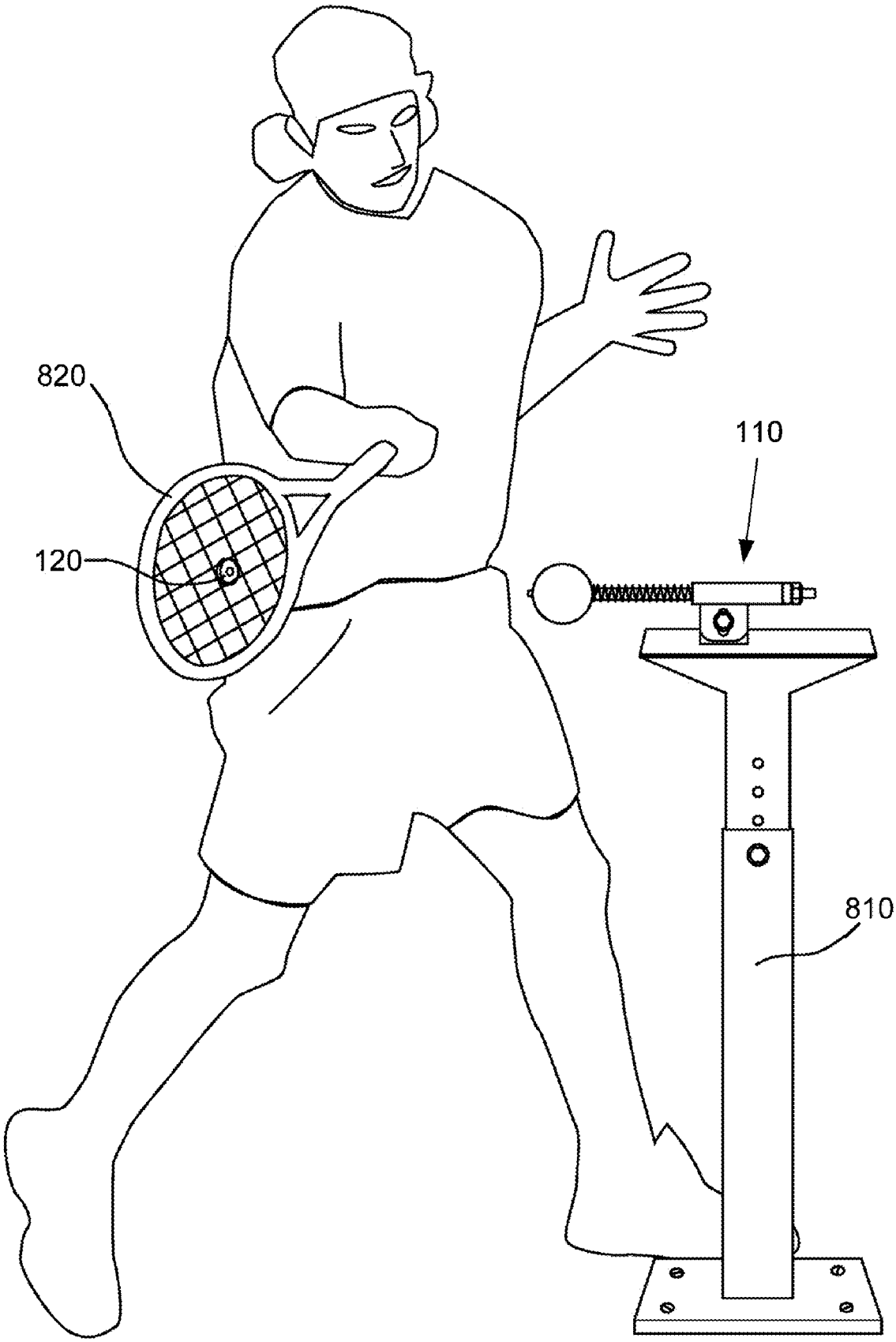
FIG. 8 is a perspective of an embodiment of the invention in use on a tennis racket.

FIG. 8 illustrates use of the invention with a tennis racket (820). The plate (120) is positioned at the center of the stringed area of the tennis racket (820) and the housing (110) positioned on an adjustable stand (810).

In the preferred method of using the device, a player implements steps comprising swinging the sports implement (218) in slow motion towards the ball (210) on the housing (110), the housing (110) preferably being immovably affixed to a surface; concentrating on the pin (212); engaging the plate (120) at the center hole (213) over the pin (212); and withdrawing the sports implement (218).

The sports implement (218) preferably passes through a complete range of motion experienced when using the sports implement (218) in actual play. Optionally, the player may use such force as to additionally implement a step of sliding the rod (222) within the tube (226) and thereby compressing the compression spring (220). When this step is implemented and the player withdraws the sports implement (218), the rod (222) is then released to return by action of the compression spring (220).

Figure 9:
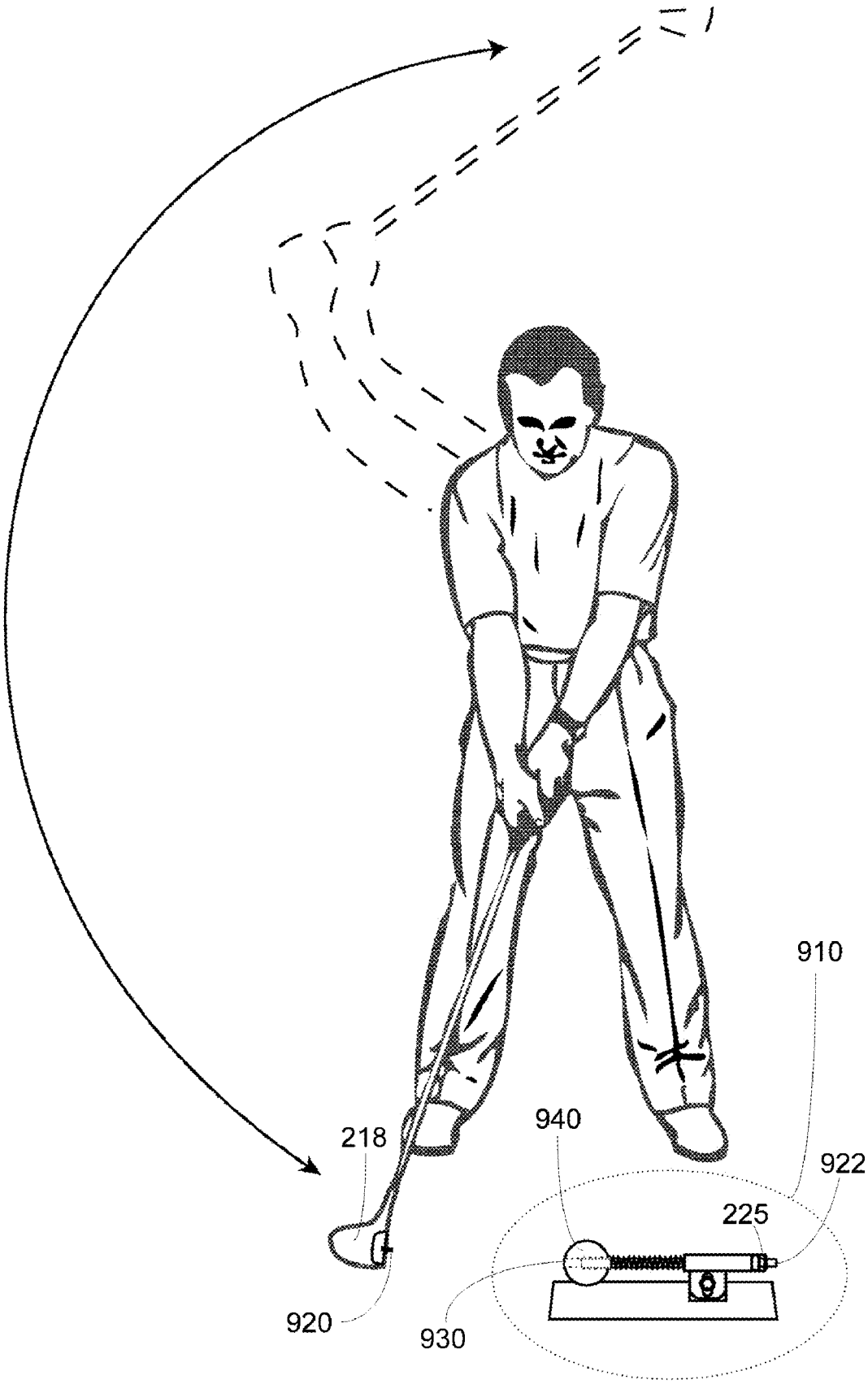
FIG. 9 is a frontal view of a golfer using an alternative embodiment of the device having a pin on the clubface engaging a hole in a ball.

FIG. 9 illustrates an alternative embodiment reversing the pin and engaging hole such that the pin would be on the sports instrument and the hole would be in the ball similarly attached to the housing (910). Thus, this embodiment has a ball (940) having a central hole (930) therethrough sufficient to slide one end of the central hole (930) on the rod (922) at the end opposite the stop (225) and present a vacant space at its opposite end; and, a pin (920) removably affixed to the sports implement (218) at its sweet spot and approximately perpendicular thereto of a size fitting within the central hole (930) in the ball (940).

Figure 10:
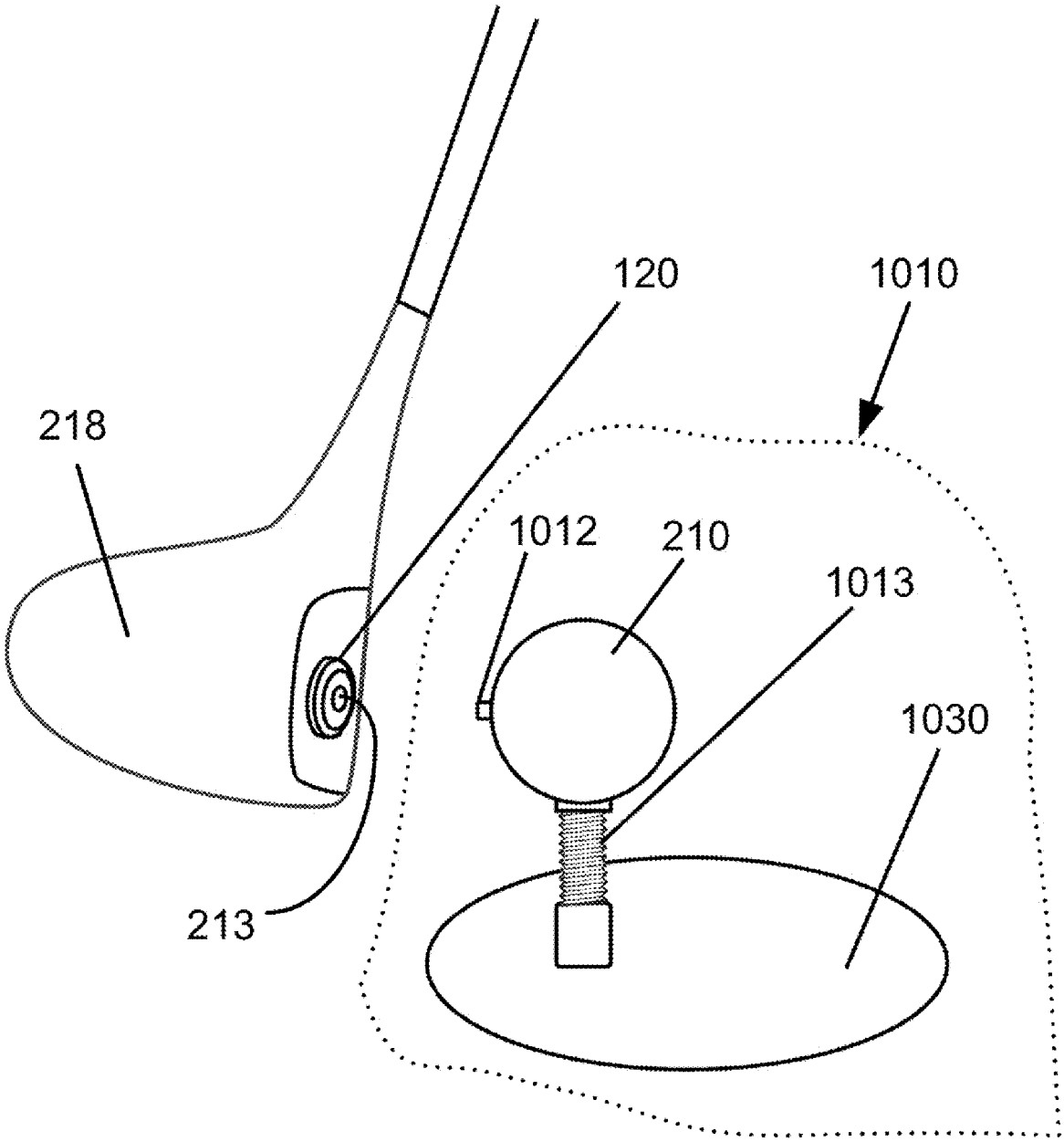
FIG. 10 is a side perspective of an alternative embodiment of the device in use with a golf club immediately prior to impact.

FIG. 10 illustrates an alternative embodiment of the invention for training a person in slow motion to hit a ball at the sweet spot on a sports implement. This device comprises a housing (1010) that can be removably affixed to a surface and a plate removably affixed to the sports implement at its sweet spot and having a center hole therethrough of sufficient size to contain the end of the rod protruding from the ball.

In accordance with the principles discussed above, the housing (1010) may similarly be removably affixed to the surface using any means common or convenient for such purpose, for example using double sided tape, glue, nails, clamps, or weights.

The housing (1010) first comprises a base plate (1030), which is essentially a flat plate. The housing (1010) performs a similar function as described above for the other embodiments in that it forms a securing platform for other components of the housing (1010).

The housing (1010) next comprises a rod (1013) extending approximately vertically from the base plate (1030). The rod (1013) is preferably a solid bar of any cross-section, a coiled spring, or any component capable of forming an elevated site for mounting a ball.

The housing (1010) next comprises a ball (210) affixed to the rod (1013) at an end of the rod (1013) opposite the base plate (1030). As described above, the ball (210) may be any type of projectile impelled by human effort through the use of an instrument in a game.

The housing (1010) next comprises a pin (1012) extending approximately horizontally from the ball. Preferably, the pin (1012) is separately attached, screwed into the ball (210), or may be an integral part of the rod (1013).

Figure 11:
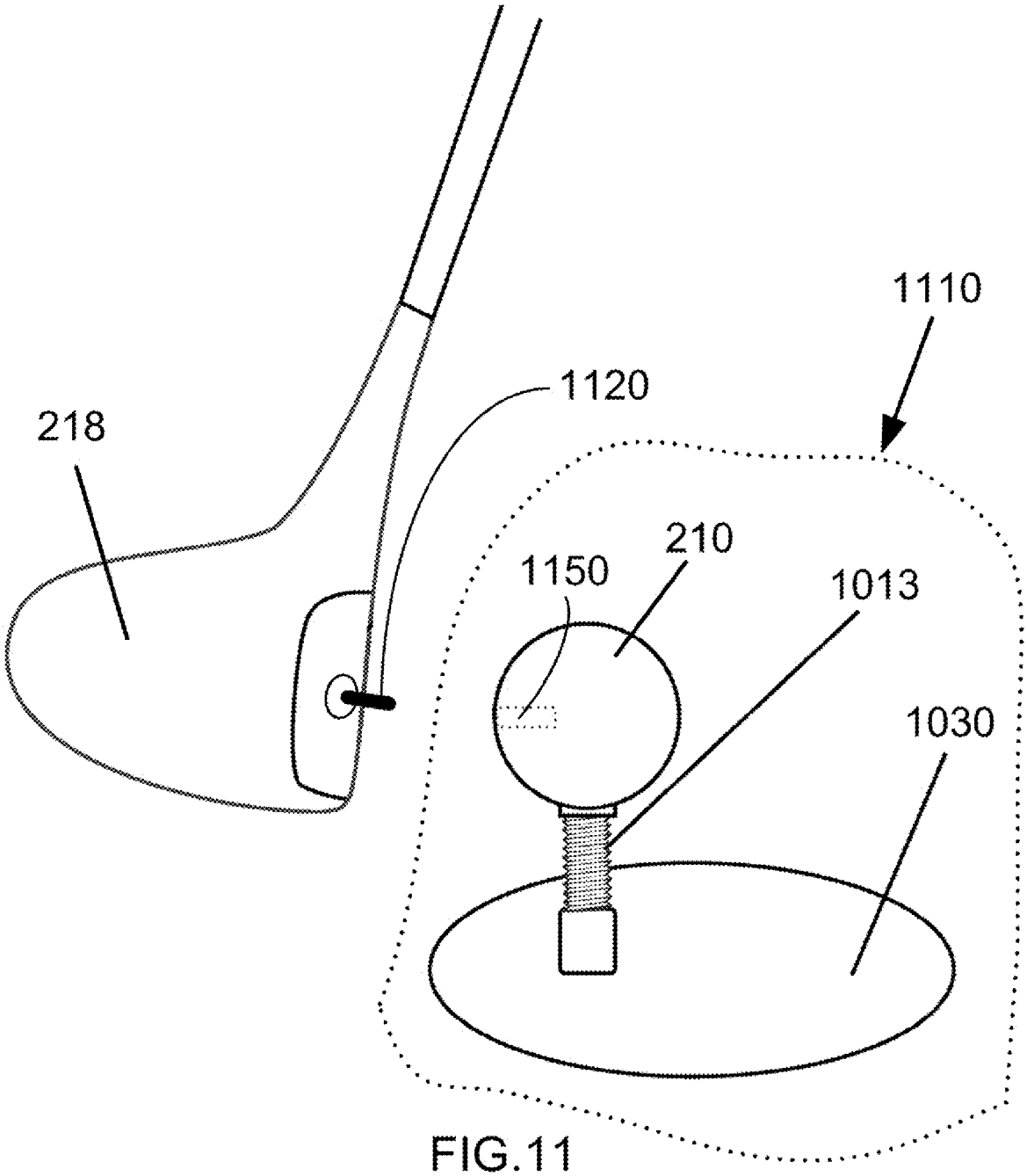
FIG. 11 is a side perspective of an alternative to the embodiment of FIG. 10 having a pin on the clubface engaging a hole in a ball.

FIG. 11 is a side perspective of an alternative to the embodiment of FIG. 10 having a pin on the clubface engaging a hole in a ball. This device comprises a housing (1110) configured to be removably affixed to a surface and comprising: a base plate (1030); a rod (1013) extending approximately vertically from the base plate (1030); a ball (210) affixed to an end of the rod (1013) opposite the base plate (1030) and configured to define a hole (1150) at the surface of the ball (210) extending radially inwardly and approximately horizontally; and, a pin (1120) removably affixed to the sports implement (218) at its sweet spot and approximately perpendicular thereto of a size fitting within the hole (1150).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to industries involved in supplying sporting goods to players of games involving physical skills in using a swingable implement to put the projectile into motion, such as baseball, polo, badminton, squash, and table tennis.

What is claimed is:

1. A device for training a person in slow motion to hit a ball at the sweet spot on a sports implement comprising:

(a) a housing configured to be removably affixed to a surface and comprising:

(1) a tube having an internal lip at one end and adjustably fixed to the housing;

(2) a rod slidably fitting within the tube;

(3) a stop affixed to an end of the rod to stop movement of the rod in one direction by abutting the end of the tube with the lip;

(4) a compression spring surrounding the rod and configured to slidably fit within the tube up to the internal lip in the tube so as to resist movement of the rod through the tube;

(5) a ball affixed to an end of the rod opposite the stop; and, (6) a pin affixed to the ball and configured to extend radially outward from the ball; and, (b) a plate removably affixed to the sports implement at its sweet spot and configured to define a center hole therethrough of sufficient size to contain the pin.

2. The device of claim 1 wherein the sports implement is selected from a group consisting of a golf club and a tennis racket.

3. The device of claim 1 further comprising a shock-absorbing rubber bumper placed between the stop and the end of the tube with the internal lip.

4. The device of claim 1 further comprising an embossment fitting over the rod and configured to provide a friction fit of the ball on the rod.

5. A method of using the device of claim 1 comprising the steps of: swinging the sports implement in slow motion towards the ball on the housing; concentrating on the pin; engaging the plate at the center hole over the pin; and, withdrawing the sports implement.

6. The method of claim 5 further comprising the step of sliding the rod within the tube and thereby compressing the compression spring.

7. A device for training a person in slow motion to hit a ball at the sweet spot on a sports implement comprising:

(a) a housing configured to be removably affixed to a surface and comprising:

(1) a tube having an internal lip at one end and adjustably fixed to the housing;

(2) a rod slidably fitting within the tube;

(3) a stop affixed to an end of the rod to stop movement of the rod in one direction by abutting the end of the tube with the lip;

(4) a compression spring surrounding the rod and slidably fitting within the tube up to the internal lip in the tube so as to resist movement of the rod through the tube; and, (5) a ball affixed to an end of the rod opposite the stop and configured to define a hole at the surface of the ball extending radially inwardly and approximately horizontally; and, (b) a pin removably affixed to the sports implement at its sweet spot and approximately perpendicular thereto of a size fitting within the hole.

8. A device for training a person in slow motion to hit a ball at the sweet spot on a sports implement comprising:

(a) a housing configured to be removably affixed to a surface and comprising:

(1) a base plate;

(2) a rod extending approximately vertically from the base plate;

(3) a ball affixed to the rod at an end of the rod opposite the base plate;

(4) a pin extending approximately horizontally from the ball; and, (b) a plate removably affixed to the sports implement at its sweet spot and configured to define a center hole therethrough of sufficient size to contain the end of the rod protruding from the ball.

9. A device for training a person in slow motion to hit a ball at the sweet spot on a sports implement comprising:

(a) a housing configured to be removably affixed to a surface and comprising:

(1) a base plate;

(2) a rod extending approximately vertically from the base plate;

(3) a ball affixed to an end of the rod opposite the base plate and configured to define a hole at the surface of the ball extending radially inwardly and approximately horizontally; and, (b) a pin removably affixed to the sports implement at its sweet spot and approximately perpendicular thereto of a size fitting within the hole.

* * * * *